US007071607B2

(12) United States Patent
Kijima et al.

(10) Patent No.: US 7,071,607 B2
(45) Date of Patent: Jul. 4, 2006

(54) DISPLAY DEVICE HAVING A LARGE NUMBER OF CATHODE LINES

(75) Inventors: Yuuichi Kijima, Chousei (JP); Kenji Miyata, Hitachinaka (JP); Yoshiyuki Kaneko, Hachioji (JP); Shigemi Hirasawa, Chiba (JP); Susumu Sasaki, Chiba (JP); Hiroshi Kawasaki, Ooamishirasato (JP); Jun Ishikawa, Mobara (JP)

(73) Assignees: Hitachi Ltd., Tokyo (JP); Hitachi Device Engineering Co., Ltd., Chiba-ken (JP)

( * ) Notice: Subject to any disclaimer, the term of this patent is extended or adjusted under 35 U.S.C. 154(b) by 0 days.

(21) Appl. No.: 10/337,134

(22) Filed: Jan. 6, 2003

(65) Prior Publication Data

US 2003/0168965 A1 Sep. 11, 2003

(30) Foreign Application Priority Data

Jan. 17, 2002 (JP) ..... 2002-008229

(51) Int. Cl.
*H01J 1/304* (2006.01)

(52) U.S. Cl. ..... 313/495; 313/496; 313/497

(58) Field of Classification Search ..... 313/495–497, 313/309, 310, 336, 351
See application file for complete search history.

(56) References Cited

U.S. PATENT DOCUMENTS

| | | | | |
|---|---|---|---|---|
| 6,008,576 | A * | 12/1999 | Nakatani et al. | 313/495 |
| 6,072,272 | A * | 6/2000 | Rumbaugh | 313/470 |
| 6,144,144 | A * | 11/2000 | Cleeves et al. | 313/309 |
| 6,262,528 | B1 * | 7/2001 | Kim | 313/495 |
| 6,603,256 | B1 * | 8/2003 | Itoh et al. | 313/496 |
| 6,879,097 | B1 * | 4/2005 | Dunphy | 313/495 |
| 2002/0167265 | A1 | 11/2002 | Miyata et al. | |
| 2002/0167266 | A1 | 11/2002 | Hirasawa et al. | |

FOREIGN PATENT DOCUMENTS

JP 2001-023550 1/2001

* cited by examiner

*Primary Examiner*—Nimeshkumar D. Patel
*Assistant Examiner*—Matt Hodges
(74) *Attorney, Agent, or Firm*—Milbank, Tweed, Hadley & McCloy LLP

(57) ABSTRACT

The present invention provides a display device which can sufficiently ensure spaces for mounting distance holding members 5 when the distance holding members 5 are mounted, can facilitate the assembling and can realize the electron emission characteristics of high performance. At least two different types of gaps b, c (b<c) are provided among cathode lines 2 (2R, 2G, 2B) and the distance holding members 5 are mounted at portions of the gaps c having a larger size whereby the space for mounting the distance holding members 5 can be sufficiently ensured.

12 Claims, 13 Drawing Sheets

DISPLAY DEVICE HAVING A LARGE NUMBER OF CATHODE LINES

BACKGROUND OF THE INVENTION

The present invention relates to a display device which utilizes an electron emission into vacuum by applying an electric field.

A color cathode ray tube has been popularly used conventionally as a display device which exhibits excellent properties such as high luminance and high definition. However, along with a demand for high image quality in recent information processing apparatuses and television broadcasting, a demand for a planar display (panel display) which is light-weighted and requires a small-space while ensuring properties such as high luminance and high definition is increased.

As a typical example of such a planar display, a liquid crystal display device, a plasma display device and the like have been commercialized. Further, as the planar display device which can realize the high luminance, various types of panel-type display devices including a display device which makes use of emission of electrons from electron sources into vacuum (hereinafter, referred to as an electron emission type display device or a field emission type display device), an organic EL display which is characterized by its low power consumption and the like are expected to be commercialized soon.

Among such panel-type display devices, as the field emission type display device, a display device having an electron emission structure which is proposed by C. A. Spindt et al., a display device having a metal-insulator-metal (MIM) type electron emission structure, a display device having an electron emission structure which makes use of an electron emission phenomenon due to a quantum theory tunneling effect (also referred to as a surface conductive type electron source), a display device which makes use of an electron emission phenomenon possessed by a diamond film, a graphite film or a carbon nanotube and the like have been known.

The field emission type display device includes a back panel which forms cathode lines having field emission type electron sources and control electrodes on an inner surface thereof and a front panel which forms anodes and phosphors on an inner surface which faces the back panel in an opposed manner, wherein the display device is constituted by laminating both panels while inserting a sealing frame between inner peripheries of both panels and by evacuating the inside thereof. Further, to hold a distance between the back panel and the front panel at a given value, distance holding members are provided between the back panel and the front panel at positions away from the above-mentioned cathode lines and the control electrodes.

The back panel includes a plurality of cathode lines having electron sources and the control electrodes on a back substrate which is preferably made of glass, alumina or the like. A large number of cathode lines extend in one direction on the back substrate and are arranged in parallel in another direction. The control electrodes are arranged adjacent to the cathode lines. A large number of control electrodes extend in the above-mentioned another direction and are arranged in parallel in the above-mentioned one direction. Pixels are formed at crossing portions between the cathode lines (electron sources provided to cathode lines) and the control electrodes.

Then, an emission quantity (including ON and OFF) of electrons from the electron source is controlled in response to the potential difference between the cathode lines and the control electrodes. On the other hand, the front panel has the anodes and the phosphors on a front substrate which is formed of a light-transmitting material such as glass. The inside sealed by the sealing frame is evacuated into vacuum of $10^{-5}$ –$10^{-7}$ Torr, for example. The control electrode has electron passing holes at each crossing portion between the cathode lines and the control electrode, which allows electrons emitted from the electron source of the cathode line to transmit therethrough toward the anode side. The above-mentioned electron sources are constituted of carbon nanotube (CNT), diamond-like carbon (DLC) or other field emission cathodes, for example.

However, although the cathode lines are arranged in parallel with a gap therebetween, this gap has been set equal conventionally. Accordingly, to ensure a sufficient spaces for forming the distance holding members, it has been necessary to increase the gap between the respective cathode lines. Further, when plate-like control electrodes which are constituted of plate members are used as the control electrodes, protrusions which are brought into contact with the back substrate are formed at portions away from back faces of the plate-like control electrodes, that is, cathode lines of back substrate side, and the distance holding members are positioned at upper surfaces of the control electrodes which correspond to these protrusions. However, in this case, an extremely accurate operation is necessary to achieve the positioning or the alignment of the protrusions of the plate-like control electrodes and the cathode lines.

SUMMARY OF INVENTION

Accordingly, it is an object of the present invention to provide a display device which can realize electron emission characteristics of high performance by sufficiently ensuring mounting spaces for mounting distance holding members between each gap defined between cathode lines (electron sources) formed on a back substrate and by facilitating the assembly of the display device.

To achieve the above-mentioned object, at least two different types of gaps are provided between the cathode lines and portions where distance holding members are mounted have the larger gap. To explain typical constitutions of the present invention, they are as follows.

(1) A back substrate having a large number of cathode lines which extend in one direction and are arranged in parallel in another direction which crosses one direction formed on an inner surface thereof and a front substrate having anodes and phosphors formed on an inner surface thereof are arranged to face each other in an opposed manner with a given distance therebetween, the large number of cathode lines define at least two different types of gaps x1, x2 (gap x1>gap x2) between the large number of cathode lines formed on the inner surface of the back substrate, and distance holding members which define the distance between the back substrate and the front substrate are provided in at least some of the gaps x1.

(2) In the constitution (1), a plurality of cathode lines are formed into each one group and the gap between the groups which are arranged close to each other is set larger than the gap between the cathode lines belonging to the same group.

(3) In the constitution (2), the cathode lines are extended in one direction in a zigzag pattern and the gap between the neighboring groups is displaced in the direction which crosses the extending direction of the cathode lines corresponding to the zigzag pattern of the cathode lines.

(4) In the constitution (2) or (3), 3N (N being a natural number) pieces of cathode lines are formed into one group.

(5) In any one of the constitutions (2) to (4), the gap between the cathode lines belonging to the same group is a gap x2 and the gap between the cathode lines belonging to the groups which are arranged close to each other is a gap x1.

Due to the above-mentioned respective constitutions, by providing the distance holding members in the portions which correspond to the larger gap x1 out of two types of gaps defined between the cathode lines, it is possible to sufficiently ensure spaces for mounting the distance holding members.

(6) A back substrate having a large number of cathode lines which extend in one direction and are arranged in parallel in another direction which crosses one direction formed on an inner surface thereof and a front substrate having anodes and phosphors formed on an inner surface thereof are arranged to face each other in an opposed manner with a given distance therebetween, a large number of plate-like control electrodes are formed such that the plate-like control electrodes are arranged close to the cathode lines, extend in another direction, are arranged in parallel in one direction, and have electron passing holes formed therein, the large number of cathode lines define at least two different types of gaps x1, x2 (gap x1>gap x2) between the large number of cathode lines formed on the inner surface of the back substrate, and the plate-like control electrodes include first protrusions in at least some of the gaps x1, wherein the first protrusions approach closer to the back substrate than regions of the plate-like control electrodes where the electron passing holes are formed.

(7) In the constitution (6), the first protrusions are brought into contact with the back substrate.

(8) In the constitution (6) or (7), distance holding members which hold a distance between the back substrate and the front substrate to a given value are provided on front substrate sides of the first protrusions.

(9) In any one of the constitutions (6) to (8), the plate-like control electrodes includes second protrusions in at least some of the gaps x2, wherein the second protrusions approach closer to the back substrate than regions of the plate-like control electrodes where the electron passing holes are formed.

(10) In the constitution (9), the second protrusions have a length shorter than a length of the first protrusions as measured in an extending direction of the plate-like control electrode.

(11) In anyone of the constitutions (6) to (10), a plurality of cathode lines are formed into each one group and the gap between the cathode lines belonging to the respective groups which are arranged close to each other is the gap x1.

(12) In the constitution (11), 3N (N being a natural number) pieces of cathode lines are formed into one group.

(13) In the constitution (11) or (12), the cathode lines are extended in one direction in a zigzag pattern and the gap between the neighboring groups is displaced in the direction which crosses the extending direction of the cathode lines corresponding to the zigzag pattern of the cathode lines.

(14) In any one of the constitutions (6) to (13), the plate-like control electrodes are metal plates.

According to the above-mentioned respective constitutions, by mounting the distance holding members on the portions of the back surface of the plate-like control electrode, that is, the portions of the front panel side of plate-like control electrode which correspond to the protrusions formed on portions which are brought into contact with the back substrate, the plate-like control electrodes are also fixed to the back substrate by these distance holding members. Here, since the first protrusions are provided with the portions of the gaps x1 which satisfy the gap x1>the gap x2, the possibility that the first protrusions of the plate-like control electrode are brought into contact with the cathode lines is reduced. Further, since the distance between the gaps x2 can be narrowed, it is possible to enhance the numerical aperture. Still further, since the distance holding members are provided with the portions of the gaps x1, it is possible to sufficiently ensure the spaces for mounting the distance holding members. Here, it is not always necessary to form the first protrusions to all of the gaps x1 and the positions where the first protrusions are formed and the number of first protrusions are selected in accordance with a size such as a length, a width or a thickness, a shape or the degree of deflection of the plate-like control electrode.

(15) In a display device in which a back substrate having a large number of cathode lines which extend in one direction and are arranged in parallel in another direction which crosses one direction formed on an inner surface thereof and a front substrate having anodes and phosphors formed on an inner surface thereof are arranged to face each other in an opposed manner with a given distance therebetween, a large number of plate-like control electrodes are formed such that the plate-like control electrodes are arranged close to the cathode lines, extend in the above-mentioned another direction, are arranged in parallel in one direction, and have electron passing holes formed therein, and the plate-like control electrode includes first protrusions in regions between the cathode lines, wherein the first protrusions approach closer to the back substrate than regions of the plate-like control electrodes where the electron passing holes are formed, and two or more cathode lines are arranged between at least some neighboring first protrusions.

(16) In the constitution (15), the first protrusions are brought into contact with the back substrate.

(17) In the constitution (15) or (16), assuming the gap between the cathode lines in which the first protrusions of the plate-like control electrode are arranged as a gap x1 and the gap between the cathode lines in which the first protrusions of the plate-like control electrode are not arranged as a gap x2, a relationship the gap x1> the gap x2 is established.

(18) In any one of the constitutions (15) to (17), the plate-like control electrode includes second protrusions in at least some of regions formed between the cathode lines, wherein the second protrusions approach closer to the back substrate than regions where the electron passing holes are formed, and the second protrusions have a length shorter than a length of the first protrusion as measured in an extending direction of the plate-like control electrodes.

(19) In any one of the constitutions (15) to (18), the plate-like control electrodes are metal plates.

According to the above-mentioned respective constitutions, by bringing the first protrusions formed on the plate-like control electrode into contact with the back substrate, it is possible to set a distance between the cathode lines and the plate-like control electrode to a given value. Further, by arranging at least two or more cathode lines between at least some of first protrusions, the number of protrusions can be reduced and hence, the alignment is facilitated. Still further, by narrowing the gap between the cathode lines positioned between the first protrusions, it is possible to enhance the definition of display images. Here, the gap between the cathode lines may be set equidistant.

(20) A back substrate having a large number of cathode lines which extend in one direction and are arranged in parallel in another direction which crosses one direction formed on an inner surface thereof and a front substrate having anodes and phosphors formed on an inner surface thereof are arranged to face each other in an opposed manner with a given distance therebetween, and the gap between the cathode lines is comprised of at least two types consisting of a gap x1 and a gap x2 (the gap x1>the gap x2), and the gap between the phosphors formed on the front substrate is comprised of at least two types consisting of a gap x3 and a gap x4 (the gap x3>the gap x4) corresponding to the gap between the cathode lines.

By arranging the phosphors in conformity with the arrangement of the cathode lines, it is possible to take the alignment of the pixels which are constituted of a back panel and a front panel so that a quantity of electrons exciting the phosphors of the pixel which reaches the phosphor of the neighboring pixel can be reduced whereby the high quality image display can be obtained.

(21) In a display device in which a back substrate having a large number of cathode lines which extend in one direction and are arranged in parallel in another direction which crosses one direction formed on an inner surface thereof and a front substrate having anodes and a large number of phosphors formed on an inner surface thereof are arranged to face each other in an opposed manner with a given distance therebetween, the large number of phosphors are formed of a plurality of phosphors which are arranged in a given order, and at least one of a width of the cathode lines and a width of the phosphors is made different from each other between the phosphors having different colors in the plurality of phosphors.

(22) A back substrate having a large number of cathode lines which extend in one direction and are arranged in parallel in another direction which crosses one direction and control electrodes having electron passing holes which are arranged above and in the vicinity of the cathode lines on an inner surface thereof, and a front substrate having anodes and a large number of phosphors formed on an inner surface thereof are arranged to face each other in an opposed manner with a given distance therebetween, the large number of phosphors are formed of phosphors in a plurality of colors which are arranged in a given order, and at least one of a width of the cathode lines, the number of electron passing holes formed in the control electrodes, a size of the electron passing holes and a width of the phosphors is made different from each other between the phosphors having different colors in the plurality of phosphors.

With the provision of these constitutions (21), (22), it is easily possible to set color balances by changing a light emitting area in response to the light emitting efficiencies of phosphors having a plurality of colors whereby the display of high quality can be obtained.

(23) A back substrate having a large number of cathode lines which extend in one direction and are arranged in parallel in another direction which crosses one direction formed on an inner surface thereof and a front substrate having anodes and a large number of phosphors formed on an inner surface thereof are arranged to face each other in an opposed manner with a given distance therebetween, every three cathode lines among a large number of cathode lines are formed into one group and a gap between the cathode lines in the neighboring groups is set wider than a gap between the cathode lines within the same group, and the phosphors are arranged such that red, green and blue phosphors are formed into one group corresponding to the group of the cathode lines, wherein the green phosphor is arranged at the center of the group.

By setting the gap between the cathode lines of the neighboring groups larger than the gap between the cathode lines within the same group, it is possible to reduce a quantity of electrons of the group which impinge on the phosphors of the neighboring pixel and hence, the occurrence of color slurring can be suppressed. Further, by positioning the green phosphor which exhibits the high visibility at the center of one group, the display quality can be enhanced.

It is needless to say that the present invention is not limited to the above-mentioned constitutions and constitutions of embodiments which are explained hereinafter and various modifications are conceivable without departing from the technical concept of the present invention.

DESCRIPTION OF THE PREFERRED EMBODIMENTS

Figures 1A, 1B:
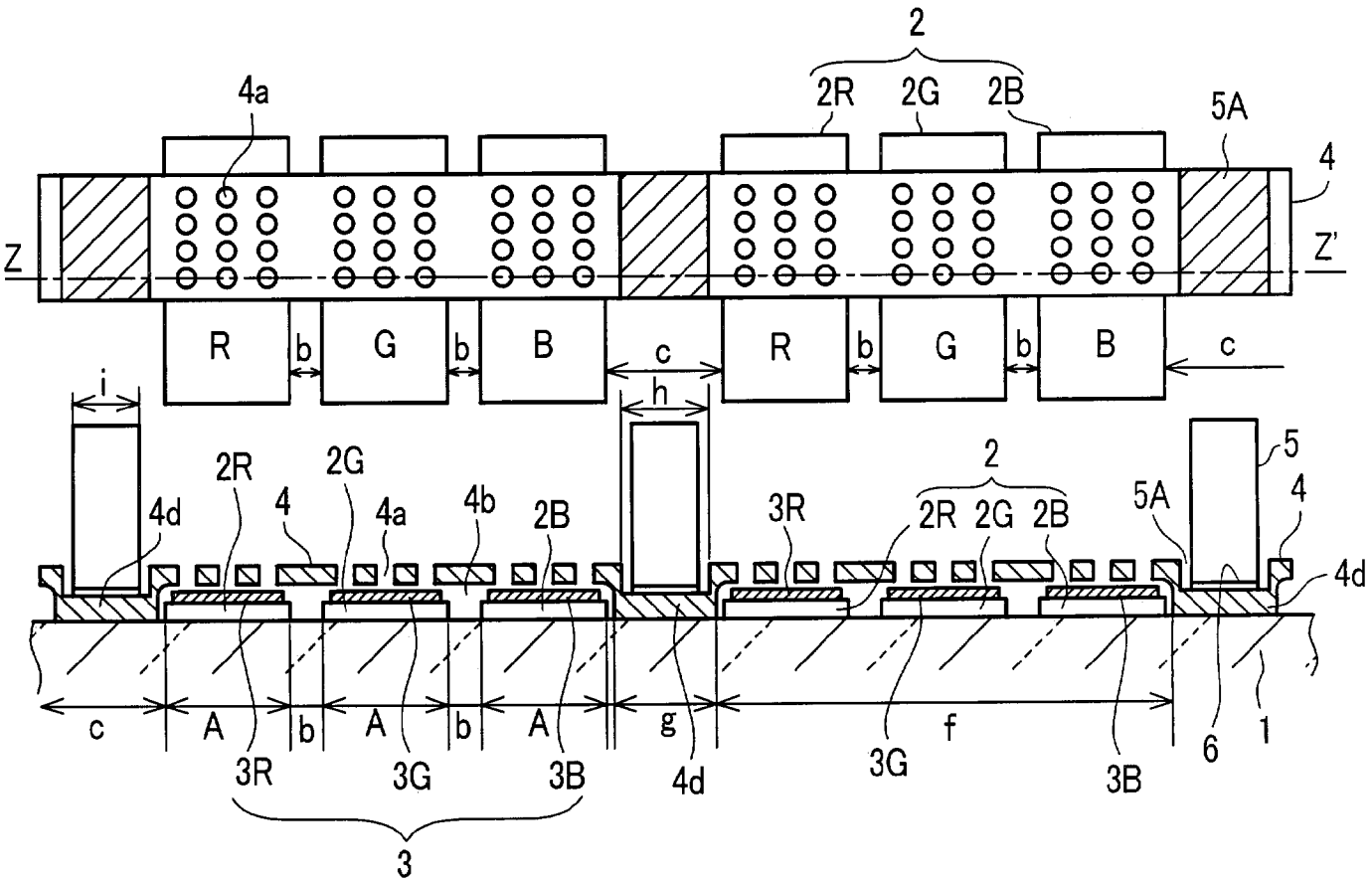
FIG. 1A and FIG. 1B are schematic views showing the constitution of a back panel side for explaining the first embodiment of a display device according to the present invention.

Preferred embodiments of a display device according to the present invention are explained hereinafter in detail in conjunction with attached drawings. FIG. 1A and FIG. 1B are schematic views showing the constitution of a back panel side for explaining the first embodiment of a display device according to the present invention, wherein FIG. 1A is a plan view of an essential part as viewed in the back panel direction from a front panel side and FIG. 1B is a cross-sectional view taken along a line Z–Z' in FIG. 1A. Numeral 1 indicates a back substrate, numeral 2 indicates cathode lines, numeral 3 indicates electron sources, numeral 4 indicates control electrodes and numeral 5 indicates distance holding members. Here, the cathode lines 2 are constituted of red cathode lines 2R, green cathode lines 2G and blue cathode lines 2B which correspond to respective phosphors of red, green and blue formed on an inner surface of a front panel not shown in the drawing.

Further, the electron sources 3 are constituted of red electron sources 3R, green electron sources 3G and blue electron sources 3B formed on respective control electrode 4 sides of the cathode lines 2R, the cathode lines 2G and the cathode lines 2B. The electron sources 3 are formed of carbon nanotubes (CNT), for example. The control electrode 4 of this embodiment is constituted of a plate member which is made of a metal plate, for example, as a separate member and the control electrode is explained hereinafter as a plate-like control electrode 4 hereinafter. The plate-like control electrode 4 is provided with electron passing holes 4*a* which are constituted of a plurality of apertures formed at positions corresponding to respective electron sources 3R, 3G, 3B at crossing portions with respective cathode lines 2R, 2G, 2B. The plate-like control electrode 4 is provided with first protrusions 4*d* which are projected toward the back substrate 1 side and are brought into contact with the back substrate 1. The arrangement of electron passing holes 4*a* is not limited to the square arrangement shown in the drawing and may adopt the staggered arrangement (also referred to as delta arrangement).

These electron passing holes 4*a* are formed by etching using a photolithography technique preferably. Further, the above-mentioned first protrusions 4*d* are also formed by etching preferably in the same manner. In FIG. 1A and FIG. 1B, three cathode lines 2R, 2G, 2B are arranged between the neighboring first protrusions 4*d*. Although the first protrusions 4*d* are described in an exaggerating manner such that the first protrusions 4*d* are projected from the plate member having the electron passing holes 4*a* toward the back substrate 1 side in a stepped manner, a recessed portion 4*b* formed by the above-mentioned etching is provided between the first protrusions 4*d*.

Further, in the front panel side of the plate-like control electrode 4 at the above-mentioned first protrusions 4*d*, distance holding member mounting portions 5A which are formed as thin film portions are simultaneously formed with the electron passing holes 4*a*. The distance holding members 5 are mounted in these distance holding member mounting portions 5A and hold the distance between the back panel and the front panel at a given value. A large number of cathode lines 2 extend in one direction and are arranged in parallel in another direction which crosses one direction on an inner surface of the back substrate 1. On the other hand, a large number of plate-like control electrodes 4 extend in the above-mentioned another direction and are arranged in parallel in one direction. Pixels are formed on crossing portions between the cathode lines 2 and plate-like control electrodes 4. Since the display device of this embodiment is a color display device, one color pixel is formed at a crossing portion between three cathode lines 2 (2R, 2G, 2B) and a plate-like control electrode 4. In a monochroic display device, one monochroic pixel is formed at a crossing portion between one cathode line and the plate-like control electrode 4 in general.

A size A in FIG. 1A and FIG. 1B indicates a width of the cathode line 2, a size b indicates a gap between the cathode lines 2 within one group, a size c indicates a gap between the cathode lines 2 extending over the neighboring groups (distance between color pixels), a size f indicates a length of the recessed portion 4*b* of the plate-like control electrode 4, a size g indicates a length of the first protrusion 4*d*, a size h indicates a length of the distance holding member mounting portion 5A, and a size i indicates a thickness of the distance holding member 5. Among these sizes, relationships c>b, g>h, h>i are established. Here, the distance holding members 5 are not shown in FIG. 1A.

As shown in FIG. 1A and FIG. 1B, every three cathode lines 2 are formed into one group. The gap c between groups is set larger than the gap b within the group. This relationship is hereinafter called as grouping, the gaps b among the cathode lines 2R, 2G, 2B are set equal and the gaps c between groups which are arranged at both sides of the first protrusion 4*d* are set slightly larger than the length g of the first protrusion 4*d*. That is, assuming the gap c between the groups as a gap x1 and the gaps b among the cathode lines 2R, 2G, 2B of respective colors as a gap x2, these gaps are set to satisfy the relationship gap x1>gap x2.

With respect to the distance holding members 5 which are mounted in the distance holding member mounting portions 5A, although the distance holding members 5 may be directly brought into contact with the plate-like control electrode 4 at the distance holding member mounting portions 5A, the distance holding members 5 may be indirectly brought into contact with the plate-like control electrode 4 by interposing adhesive agents 6 (or insulation layers) as shown in FIG. 1B. Including the direct contact and the indirect contact, the expression that the distance holding members 5 are brought into contact with the plate-like control electrode 4 is adopted in this specification. Although the distance holding members 5 are mounted in all of the distance holding member mounting portions 5A formed on the plate-like control electrode 4, provided that the distance between the panels where the inside between the panels is evacuated can be held against the atmospheric pressure or the like, the distance holding member mounting portions 5A may be arranged every one other, every two or more other or at random.

In this manner, by adopting the grouping constitution which prepares two or more types of gaps between the cathode lines 2, it is possible to reduce electrons which impinge on the phosphor of the pixel of the neighboring group. Although it is preferable to make the grouping every three lines corresponding to red, green and blue, the grouping may be made every 3N pieces (N being a natural number) or every other-number pieces.

Further, since it is possible to ensure spaces for arranging the distance holding member 5 due to this grouping, it is possible to arrange the distance holding members 5 at positions where the gap is wide. Accordingly, it is possible to set the gap x2 to an allowable minimum value and hence, the numerical aperture can be enhanced. Here, in arranging the distance holding members 5 at positions where the gaps x1 are positioned between the groups, it is unnecessary to arrange the distance holding members 5 at all gaps x1 and the number of the distance holding members 5 may be reduced by arranging them every two other groups.

It is not always necessary to provide the control electrodes as separate members such as plate members. That is, the control electrodes may be formed such that an insulation layer is formed on the back substrate 1 and the control electrodes maybe directly formed on the insulation layer using a film forming technique such as coating or vapor deposition. Further, the distance holding members 5 maybe arranged by obviating positions where the control electrodes such as plate-like control electrodes 4 are formed. Alternatively, it may be possible to adopt a so-called under-gate structure in which the control electrodes are provided below the cathode lines 2. Further, the grouping can be applicable to a diode structure which does not use control electrodes.

When the grouping and the plate-like control electrodes 4 having the first protrusions 4*d* are combined, by providing the first protrusions 4*d* at the positions where the gap x1 is arranged between the groups, the positioning is facilitated compared to a case in which the first protrusions 4*d* are provided at the positions where the gap x2 is arranged. Further, it is possible to reduce the possibility that the first protrusions 4*d* are brought into contact with the cathode line 2. Still further, when the protrusions are not arranged at the position where the gap x2 is formed, it is possible to set the gap x2 to a minimum value and hence, the numerical aperture can be enhanced.

It is not always necessary to provide the first protrusion 4*d* for every one group and the number of the first protrusions 4*d* may be reduced by providing the first protrusion 4*d* for every two or more groups or at random in view of a size such as a length, a width, a thickness or the like, a shape or shape holding characteristics such as the degree of deflection of the plate-like control electrodes 4. In this case, the positioning is further enhanced.

Irrespective of whether the grouping is adopted or not, when the protrusions (without being limited to the first protrusions 4*d* and including all protrusions formed at positions disposed in the gap between the cathode lines 2) are formed on the plate-like control electrode 4, it is preferable to arrange two or more cathode lines 2 between the neighboring protrusions with respect to all protrusions. However, it may be possible to adopt the constitution in which two or more cathode lines 2 are present in the neighboring protrusions with respect to at least some of the protrusions. In both cases, it is possible to reduce the number of protrusions compared to the case in which the protrusion is formed between the cathode lines with respect to all cathode lines. Accordingly, the positioning is facilitated and the possibility of contact between the protrusions and the cathode lines can be reduced.

Here, although the protrusions such as the first protrusions 4*d* and the like fix or support the plate-like control electrodes 4 by being in contact with the back substrate 1, it is not always necessary to bring the protrusions into direct contact with the back substrate 1 and it is possible to bring the protrusions into indirect contact with the back substrate 1 by interposing an adhesive agent or an insulation layer therebetween. Here, the expression that the protrusions are brought into contact with the back substrate 1 includes both of the direct contact and the indirect contact.

When the grouping of cathode lines 2, the plate-like control electrodes 4 having the first protrusions 4*d* and the distance holding members 5 are combined, it is possible to fix the plate-like control electrodes 4 by arranging the distance holding members 5 on the plate-like control electrodes 4. In this case, by providing the first protrusions 4*d* at the position where the gap x1 is arranged between the groups and by arranging the distance holding members 5 on the first protrusions 4*d*, the deflection of the plate-like control electrode 4 can be preferably reduced. Although the distance holding member mounting portion 5A is formed such that the portion 5A is indented than a periphery thereof for preventing the displacement of the first protrusion 4*d* in FIG. 1B, the distance holding member mounting portion 5A may be formed coplanar with the periphery thereof.

According to this embodiment which forms three cathode lines 2 constituting one color pixel into one group, it is possible to sufficiently ensure the spaces for mounting the distance holding members 5, to reduce the possibility that the first protrusions 4*d* of the plate-like control electrodes 4 are brought into contact with the cathode lines 2, and to enhance the numerical aperture. Although three cathode lines 2 which constitute one color pixel are formed into one group in FIG. 1A to FIG. 1B, two or more color pixels can be formed into one group. The same goes for embodiments explained hereinafter.

Figures 2A, 2B, 2C:
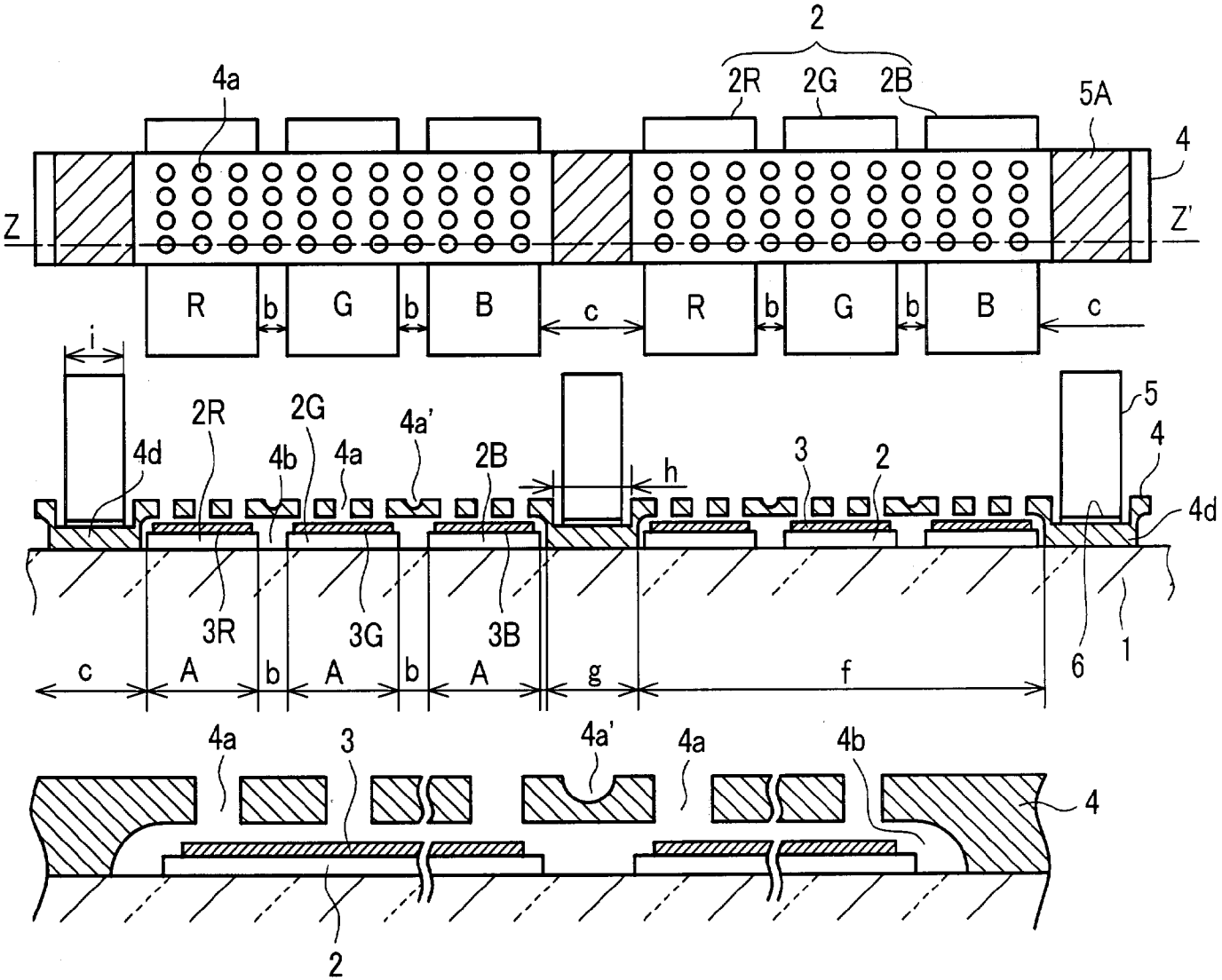
FIG. 2A to FIG. 2C are schematic views showing the constitution of the back panel side for explaining a modification of the first embodiment of the display device according to the present invention.

FIG. 2A to FIG. 2C are schematic views showing the constitution of a back panel side for explaining a modification of the first embodiment of the display device according to the present invention, wherein FIG. 2A is a plan view of an essential part as viewed in the back panel direction from a front panel side, FIG. 2B is a cross-sectional view taken along a line Z–Z' in FIG. 2A, and FIG. 2C is an enlarged cross-sectional view of an essential part. The constitution of this modification differs from the constitution of the first embodiment shown in FIG. 1A and FIG. 1B in that, a recessed portion 4*a*' is formed at each region of the plate-like control electrode 4 between the cathode lines 2.

This recessed portion 4*a*' is also referred to as a half etch and is formed as a non-penetrating opening at the time of forming the electron passing holes 4*a* by etching processing. By forming this recessed portion 4*a*' between the neighboring cathode lines 2, when the plate-like control electrode 4 is mounted in a state that a tension is applied to the plate-like control electrode 4 or when the thermal deformation which is generated along with the operation of the display device is locally concentrated on the plate-like control electrode 4, it is possible to suppress the local elongation of the plate-like control electrode 4, the fluctuation of the distance between the cathode lines 2 and the plate-like control electrodes 4, and the change of the shape of the electron passing holes 4*a*.

This modification can also obtain the advantageous effects brought about by the grouping of the cathode lines 2 in the same manner as the first embodiment. This modification also shares the same constitution with the first embodiment with respect to other constitutions. The recessed portion 4*a*' may be formed not only each region between the neighboring cathode lines 2 but also on the entire region of the plate-like control electrode 4. The recessed portions 4*a*' are applicable to respective embodiments which will be explained hereinafter as modifications of these embodiments in the same manner and hence, the repeated explanation is omitted in respective embodiments hereinafter.

Figure 3A:
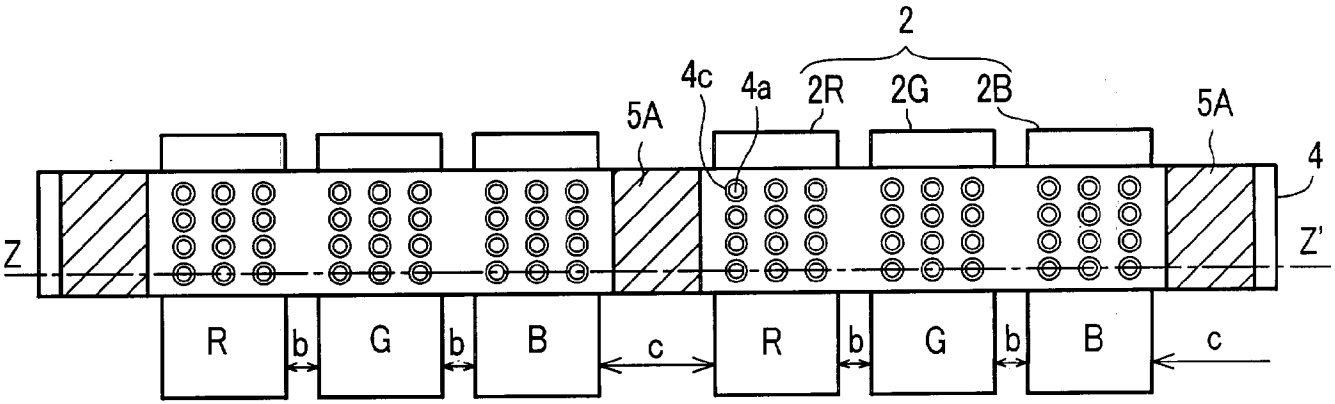
FIG. 3A to FIG. 3C are schematic views showing the constitution of the back panel side for explaining the second embodiment of the display device according to the present invention.
Figure 3B:
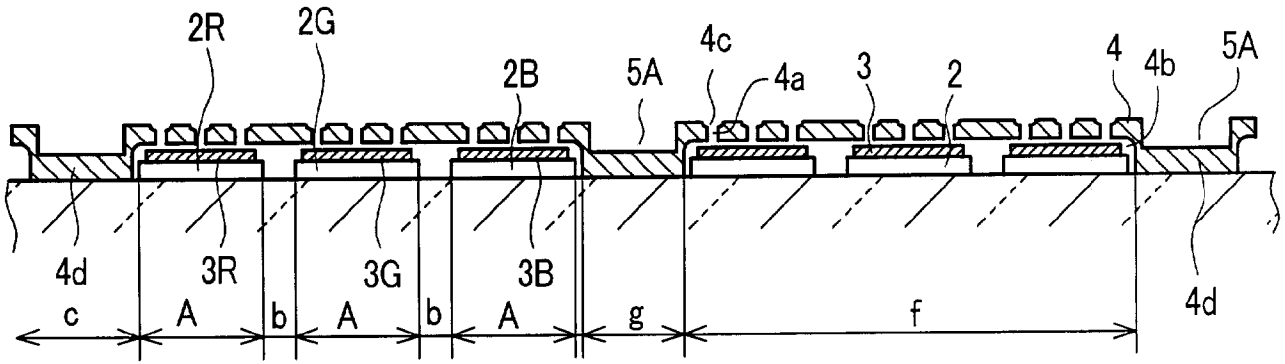
Figure 3C:
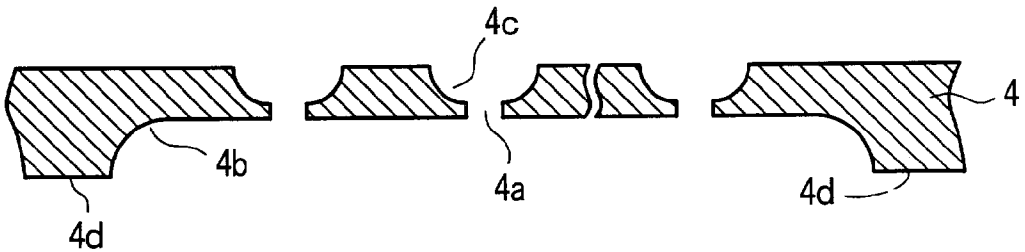

FIG. 3A to FIG. 3C are schematic views showing the constitution of a back panel side for explaining the second embodiment of the display device according to the present invention, wherein FIG. 3A is a plan view of an essential part as viewed in the back panel direction from a front panel side, FIG. 3B is a cross-sectional view taken along a line Z–Z' in FIG. 3A, and FIG. 3C is an enlarged cross-sectional view of a plate-like control electrode. In the drawings, reference numerals which are equal to those used in FIG. 1A and FIG. 1B indicate identical functional parts. The overall schematic constitution of this embodiment is similar to the overall schematic constitution shown in FIG. 1A and FIG. 1B or in FIG. 2A to FIG. 2C. The constitution of this embodiment differs from the constitution of the first embodiment shown in FIG. 1A and FIG. 1B in that large-diameter portions 4*c* are formed on front surfaces (that is, on surfaces at a front panel side not shown in the drawing) of the electron passing holes 4*a* which are formed in the plate-like control electrode 4. Here, the distance holding members 5 are omitted from the drawings.

According to this embodiment, while it is possible to obtain the advantageous effects brought about by the grouping of the cathode lines 2 in the same manner as the first embodiment, it is also possible to correct the imbalance of thermal deformation attributed to the recessed portions 4*b* formed on the back face by forming the large-diameter portions 4*c* at the front panel side of the electron passing holes 4*a* so that the deformation of the plate-like control electrode 4 can be suppressed.

Figure 4A:
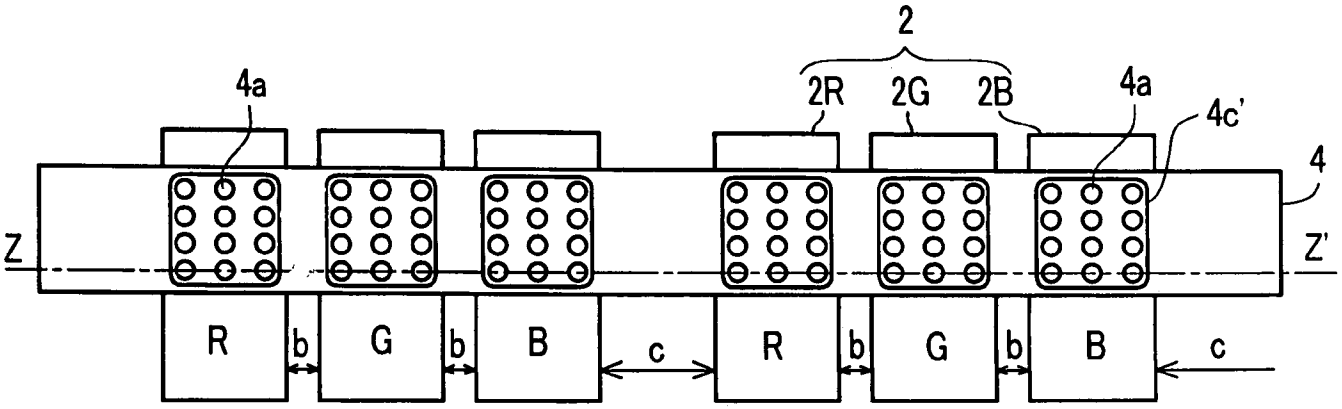
FIG. 4A to FIG. 4C are schematic views showing the constitution of the back panel side for explaining the third embodiment of the display device according to the present invention.
Figure 4B:
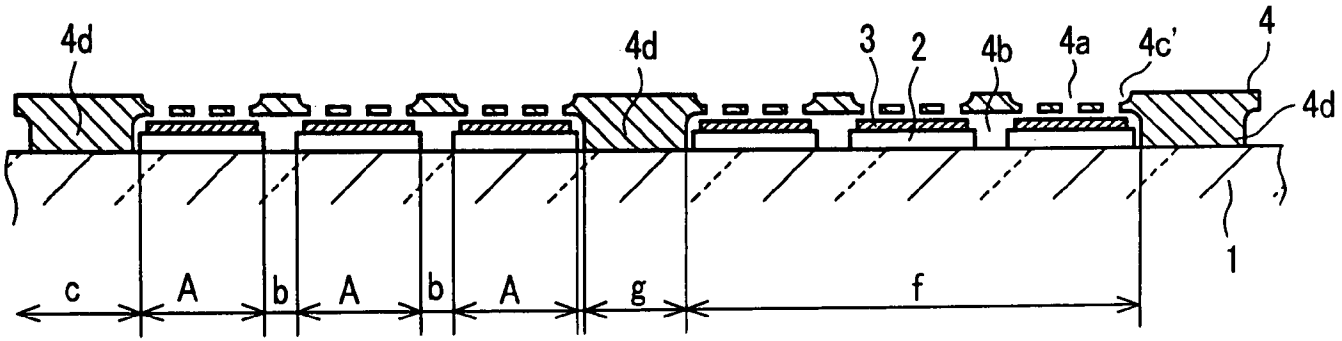
Figure 4C:
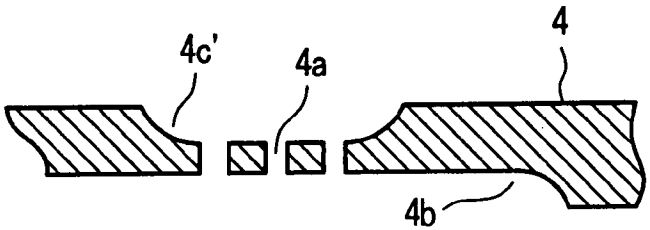

FIG. 4A to FIG. 4C are schematic views showing the constitution of a back panel side for explaining the third embodiment of the display device according to the present invention, wherein FIG. 4A is a plan view of an essential part as viewed in the back panel direction from a front panel side, FIG. 4B is a cross-sectional view taken along a line Z–Z' in FIG. 4A, and FIG. 4C is an enlarged cross-sectional view of an essential part of a plate-like control electrode. In the drawings, reference numerals which are equal to those used in FIG. 1A to FIG. 3C indicate identical functional parts. Here, the distance holding members 5 are omitted from the drawings. Further, in this embodiment, thin walled portions which are formed in the previous embodiments as the distance holding member mounting portions 5A for mounting the distance holding members 5 are not formed in the plate-like control electrode 4. However, this embodiment is not limited to such a constitution.

Although the large-diameter portion 4*a* is formed in the plate-like control electrode 4 for every electron passing hole 4*a* in the embodiment shown in FIG. 3A to FIG. 3C, in this embodiment, a common large-diameter portion 4*c*' is formed over the whole area of a plurality of electron passing holes 4*a* provided to the crossing portion between the plate-like control electrode 4 and the cathode line 2. According to this embodiment, it is possible to ensure the space for mounting the distance holding member 5 in the same manner as the previous embodiments. Further, the possibility that the first protrusions 4*d* of the plate-like control electrodes 4 are brought into contact with the cathode lines 2 can be reduced. Accordingly, while it is possible to obtain the advantageous effects brought about by the grouping of the cathode lines 2 and the advantageous effect that the numerical aperture can be enhanced in the same manner as the previous embodiment, it is also possible to correct the imbalance of thermal deformation attributed to the recessed portions 4*b* formed on the back face by forming the common large-diameter portions 4*c*' at the front panel side of the electron passing holes 4*a* so that the deformation of the plate-like control electrode 4 can be suppressed.

Figure 5A:
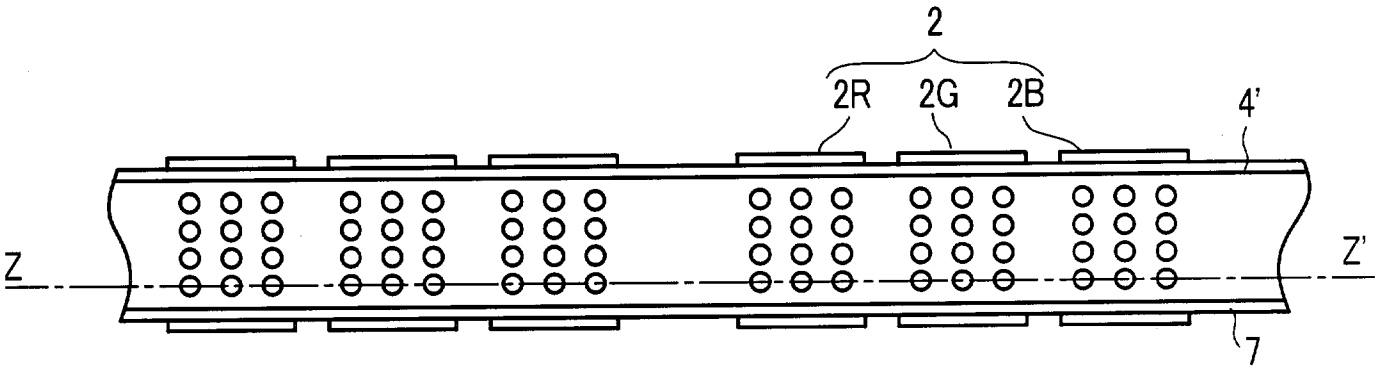
FIG. 5A and FIG. 5B are schematic views showing the constitution of the back panel side for explaining the fourth embodiment of the display device according to the present invention.
Figure 5B:
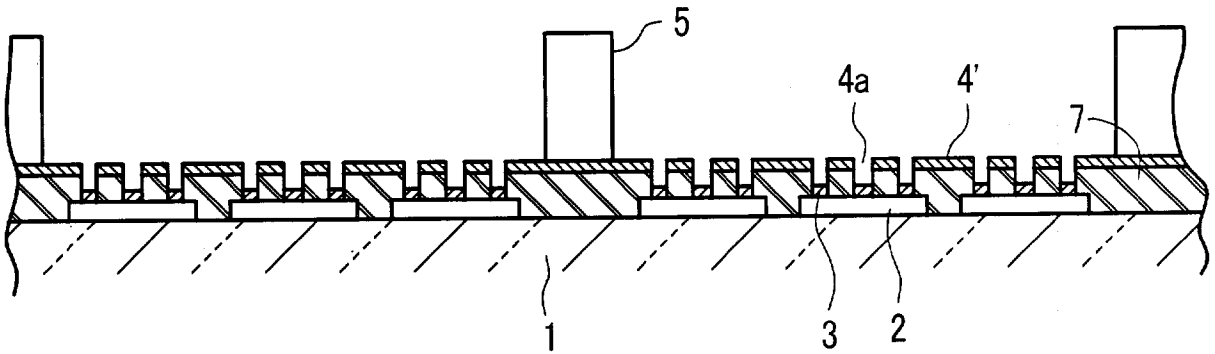

FIG. 5A and FIG. 5B are schematic views showing the constitution of a back panel side for explaining the fourth embodiment of the display device according to the present invention, wherein FIG. 5A is a plan view of an essential part as viewed in the back panel direction from a front panel side and FIG. 5B is a cross-sectional view taken along a line Z–Z' in FIG. 5A. This embodiment is characterized by using a thin film control electrode 4' in place of the plate-like control electrode 4 as the control electrode. The thin film control electrode 4' is formed such that an insulation layer 7 is formed on a back substrate 1 and a conductive thin film is formed on the insulation layer 7 by a technique such as vapor deposition. The insulation layer 7 has portions thereof corresponding to electron sources 3 on the cathode line 2 subjected to etching processing or the like such that the electron sources 3 are exposed thus forming electron passing holes 4*a* in the thin film control electrode 4'.

On the portions of the cathode line 2 which correspond to the electron passing holes 4*a* formed in the thin film control electrode 4', the electron sources 3 such as carbon nanotubes are mounted. Also in this embodiment, three cathode lines 2R, 2G, 2B corresponding to one color pixel are formed in one group and the gap between the neighboring groups is set larger than the gap between cathode lines 2R, 2G, 2B. Accordingly, while it is possible to obtain the advantageous effects brought about by the grouping of the cathode lines and the advantageous effect that the numerical aperture can be enhanced in the same manner as the previous embodiments, it is also possible to increase the mounting tolerance of the distance holding members 5. Although the insulation layer 7 is formed along the thin film control electrode 4' as shown in FIG. 5A, in place of such a constitution, the insulation layer 7 may be formed such that the insulation layer 7 substantially covers the whole area of the cathode line 2 except for the electron passing holes 4*a*while covering portions where the thin film control electrode 4' is not formed.

Figure 6A:
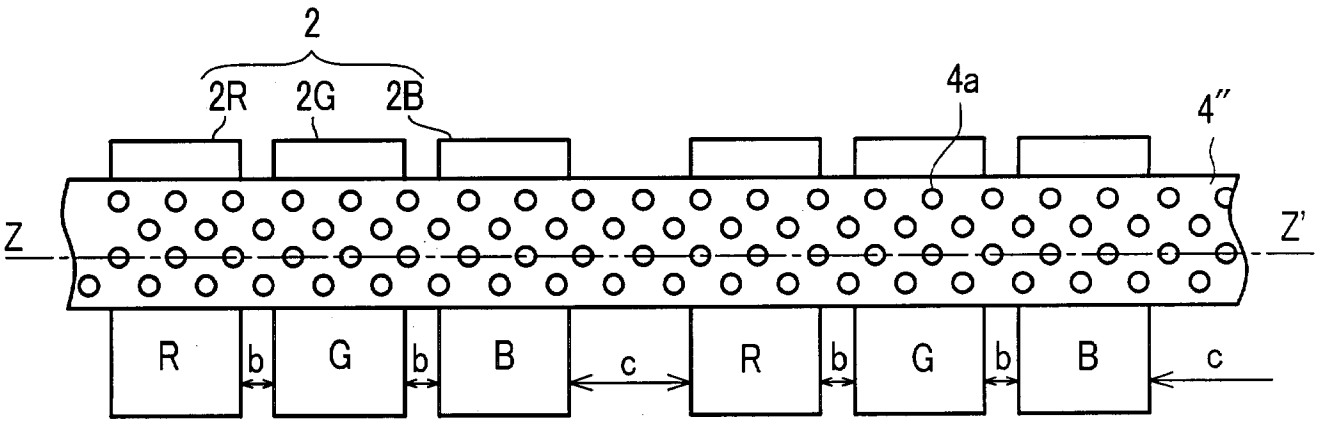
FIG. 6A and FIG. 6B are schematic views showing the constitution of the back panel side for explaining the fifth embodiment of the display device according to the present invention.
Figure 6B:
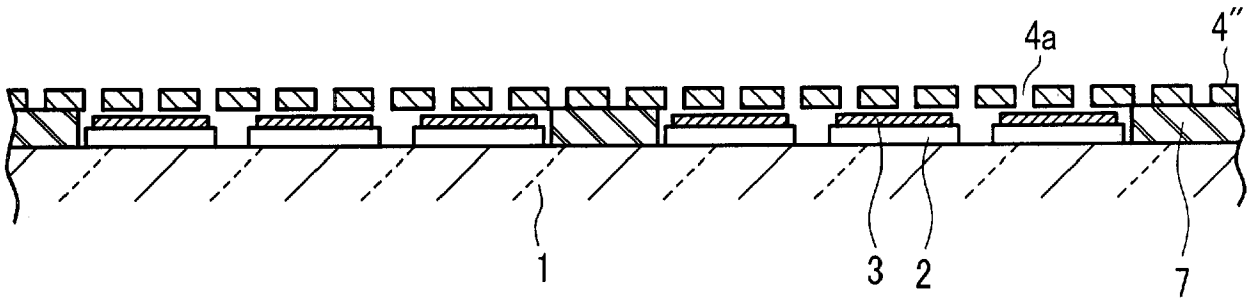

FIG. 6A and FIG. 6B are schematic views showing the constitution of a back panel side for explaining the fifth embodiment of the display device according to the present invention, wherein FIG. 6A is a plan view of an essential part as viewed in the back panel direction from a front panel side and FIG. 6B is a cross-sectional view taken along a line Z–Z' in FIG. 6A. In this embodiment, as the control electrodes, planar control electrodes 4" formed of plate-like members having no protrusions at a back substrate side are adopted. Here, the plate-like control electrode 4" constitutes one type of plate-like control electrode 4. Three cathode lines 2 which constitute one color pixel is formed into one group and a gap c defined between the neighboring groups is set larger than a gap b defined between respective cathode lines 2R, 2G, 2B.

An insulation layer 7 is formed in the gap c defined between the neighboring groups and the electron passing holes 4*a* are formed in the entire surface of the planar control electrode 4" and the distance holding member 5 not shown in the drawings is arranged at the front panel side of the gap c. The electron passing holes 4*a* are arranged in a staggered pattern (also referred to as a delta arrangement) as shown in the drawing. Due to such a constitution, while it is possible to obtain the advantageous effects brought about by the grouping of the cathode lines 2 and the advantageous effect that the numerical aperture can be enhanced in the same manner as the previous embodiments, it is also possible to largely enhance the positional tolerance of the planar control electrode 4" with respect to the cathode lines 2 (electron sources 3). Here, it is needless to say that the square arrangement may be adopted as the arrangement of the electron passing holes 4*a*.

Figure 7:
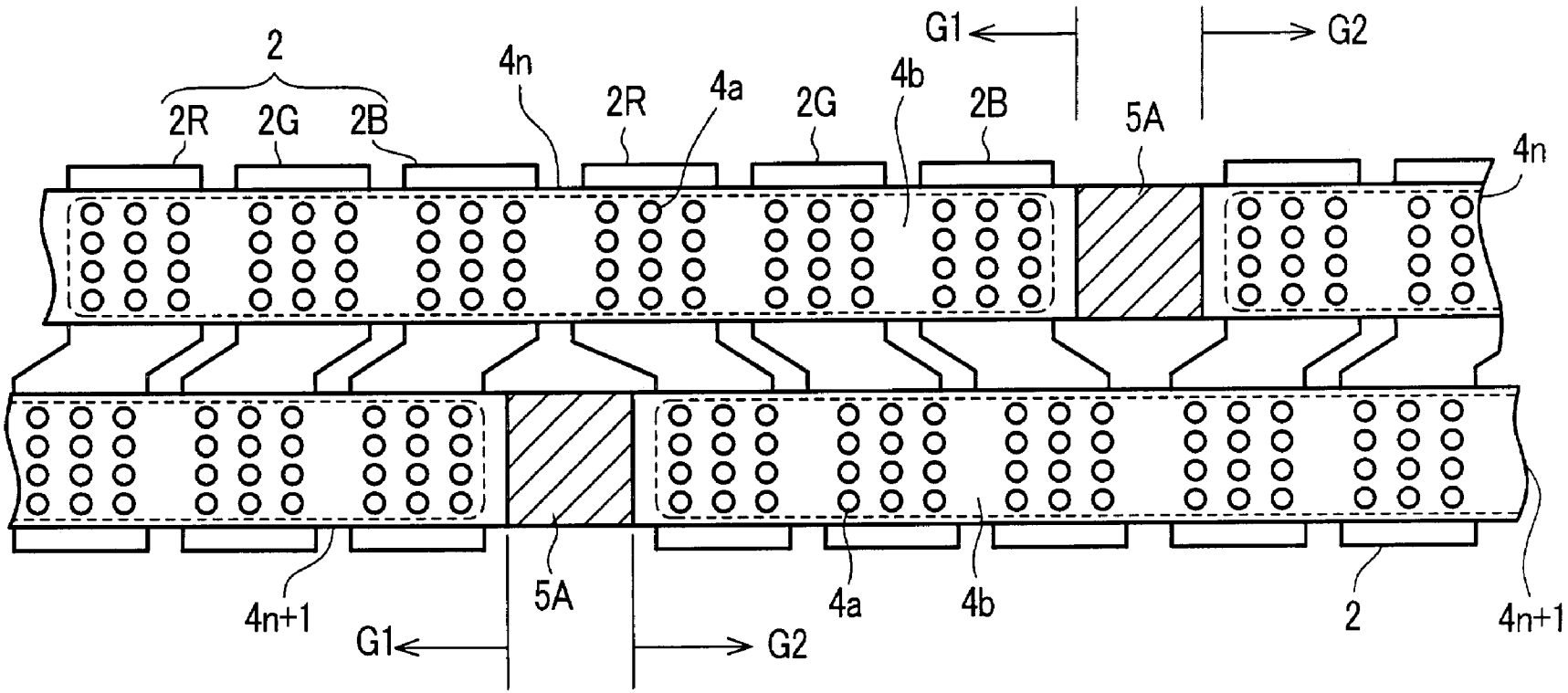
FIG. 7 is a plan view for schematically showing the constitution of the back panel side for explaining the sixth embodiment of the display device according to the present invention.

FIG. 7 is a schematic plan view showing the constitution of a back panel side for explaining the sixth embodiment of the display device according to the present invention. A plurality of groups each of which is formed of three cathode lines 2 (2R, 2G, 2B) constituting one color pixel are formed into large groups G1, G2, . . . and a distance holding member mounting portion 5A is arranged between the neighboring large groups G1, G2 . . . Further, the cathode lines 2 are arranged in a zigzag pattern for every control electrode 4*n*, 4*n*+1 and for every group and the distance holding member mounting portions 5A which are formed on the respective control electrodes 4 are displaced from each other such that they are not aligned in the extending direction of the cathode lines 2.

Further, the respective regions for the electron passing holes 4*a* of the neighboring control electrodes 4*n*, 4*n*+1 disposed above the respective cathode lines 2 are displaced in the direction which crosses the extending direction of the cathode lines 2 by ½ of a length of the region. First protrusions similar to the first protrusions which have been explained in conjunction with FIG. 1A to FIG. 4C are formed on a back substrate side of the control electrodes 4*n*, 4*n*+1, . . . That is, the protrusions which are formed between the above-mentioned large groups G1, G2, . . . are formed on the back substrate side of the distance holding member mounting portions 5A. In this embodiment, the control electrodes 4 may be formed in a zigzag pattern every two or more other control electrodes 4.

Further, it is also possible to form half etches or large diameter portions which have been explained in conjunction with the above-mentioned FIG.2A to FIG. 4C at portions of the control electrodes 4*n*, 4*n*+1 where the electron passing holes 4*a* are formed. According to this embodiment, it is possible to suppress the degradation of the display quality which may be caused when the non-light-emitting portions are aligned with each other due to the grouping and the distance holding member mounting portions 5A.

Figures 8A, 8B:
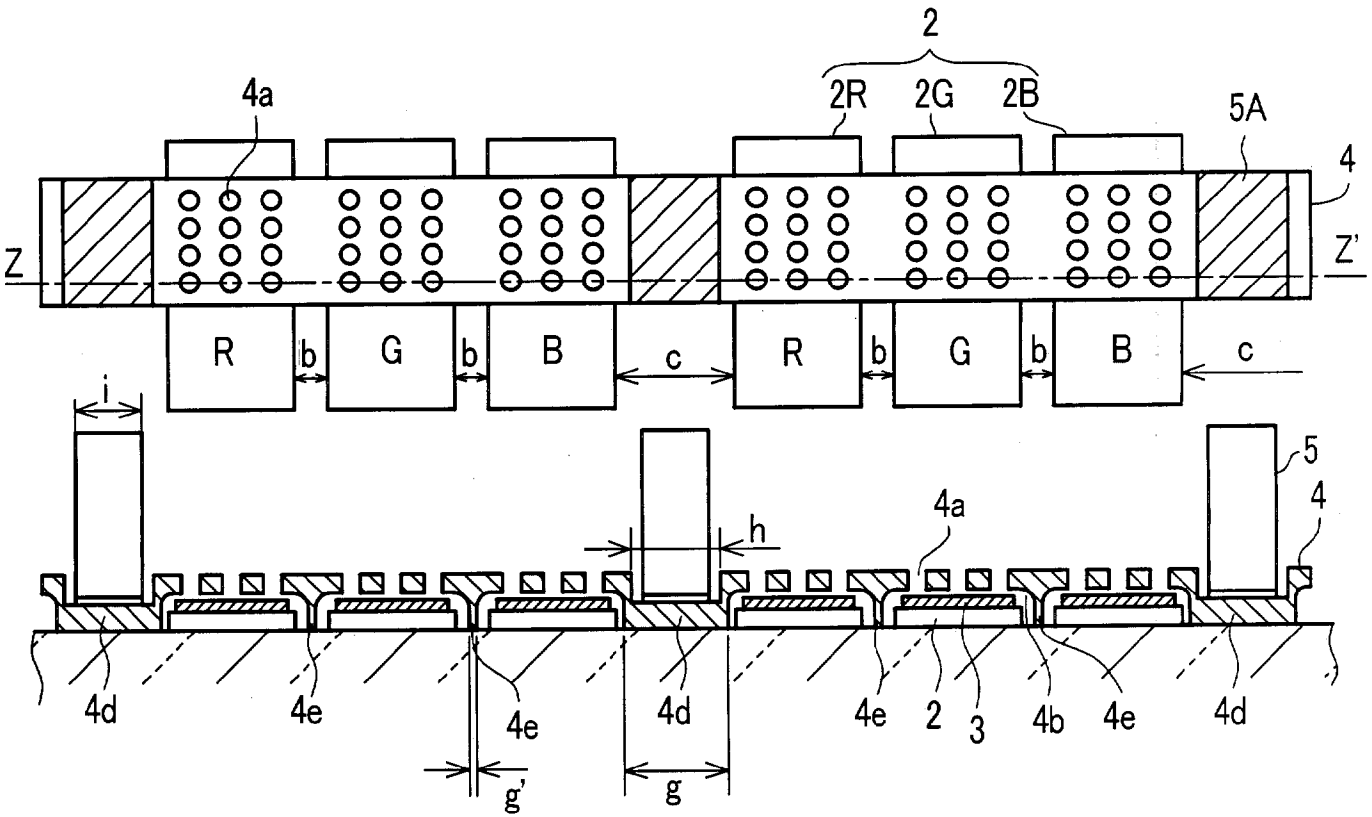
FIG. 8A and FIG. 8B are schematic views showing the constitution of the back panel side for explaining the seventh embodiment of the display device according to the present invention.

FIG. 8A and FIG. 8B are schematic views showing the constitution of a back panel side for explaining the seventh embodiment of the display device according to the present invention, wherein FIG. 8A is a plan view of an essential part as viewed in the back panel direction from a front panel side and FIG. 8B is a cross-sectional view taken along a line Z–Z' in FIG. 8A. This embodiment modifies the constitution shown in FIG. 1A to FIG. 1B such that a plate-like control electrode 4 includes second protrusions 4*e* each of which is provided between respective cathode lines 2R, 2G, 2B which constitute one group. A length g' of the second protrusion 4*e* in the extending direction of the plate-like control electrode 4 is set shorter than a length g of the first protrusions 4*d*.

That is, the above-mentioned length g' of the second protrusions 4*e* is a size which does not bring the second protrusions 4*e* into contact with the cathode lines 2 within a gap b (=gap×2) defined between the cathode lines 2R, 2G, 2B. The plate-like control electrode 4 mainly brings first protrusions 4*d* into contact with the back substrate 1 such that a pressing force from the distance holding members 5 mounted on the front panel side is applied to the back substrate 1. The second protrusions 4*e* are served for defining the distance between the plate-like control electrode 4 and the cathode lines 2 (electron sources 3) by preventing the deflection of the plate-like control electrode 4 and, at the same time, are served for preventing the plate-like control electrode 4 from being brought into contact with the cathode lines 2 (electron sources 3).

Also this embodiment can easily perform the alignment of the plate-like control electrodes 4 with the back substrate 1 on which the cathode lines 2 are formed and can ensure large spaces for mounting the distance holding members 5 which are mounted between the front panel and the back panel by way of the plate-like control electrodes 4. Further, by providing the second protrusion 4*e* of the plate-like control electrode 4 between the neighboring cathode lines 2 in one group, as mentioned above, the deflection of the plate-like control electrode 4 can be prevented so that the plate-like control electrode 4 is prevented from being in contact with the cathode lines 2 (electronic sources 3). This embodiment is similar to other embodiments with respect to other constitutions and the advantageous effects brought about by such constitutions. It is not always necessary to provide the second protrusions 4*e* to all portions of the plate-like control electrode 4. By reducing the number of the second protrusions 4*e* when necessary, it is possible to perform the alignment more easily.

Figure 9A:
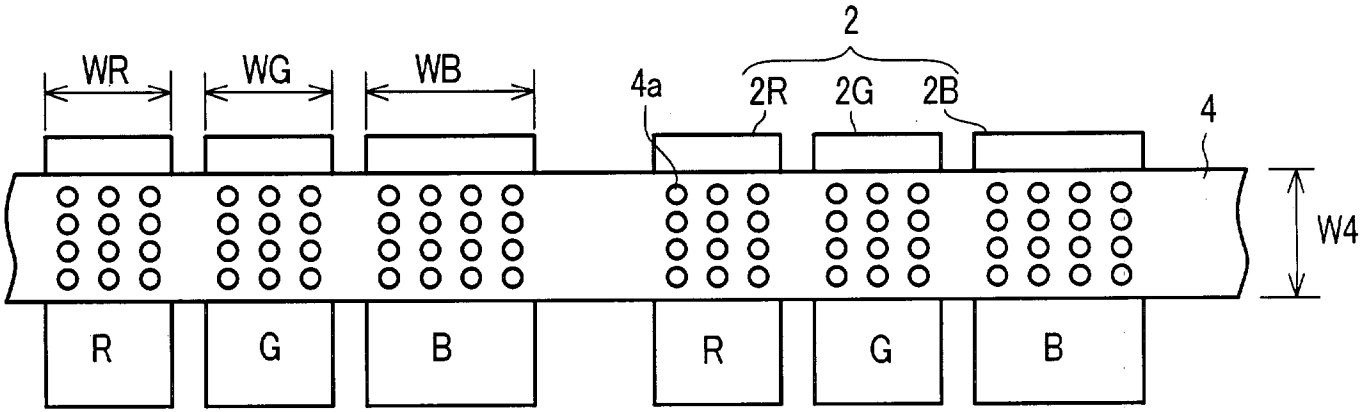
FIG. 9A and FIG. 9B are plan views of essential parts as viewed in the back panel direction from a front panel side for explaining the eighth embodiment of the display device according to the present invention.
Figure 9B:
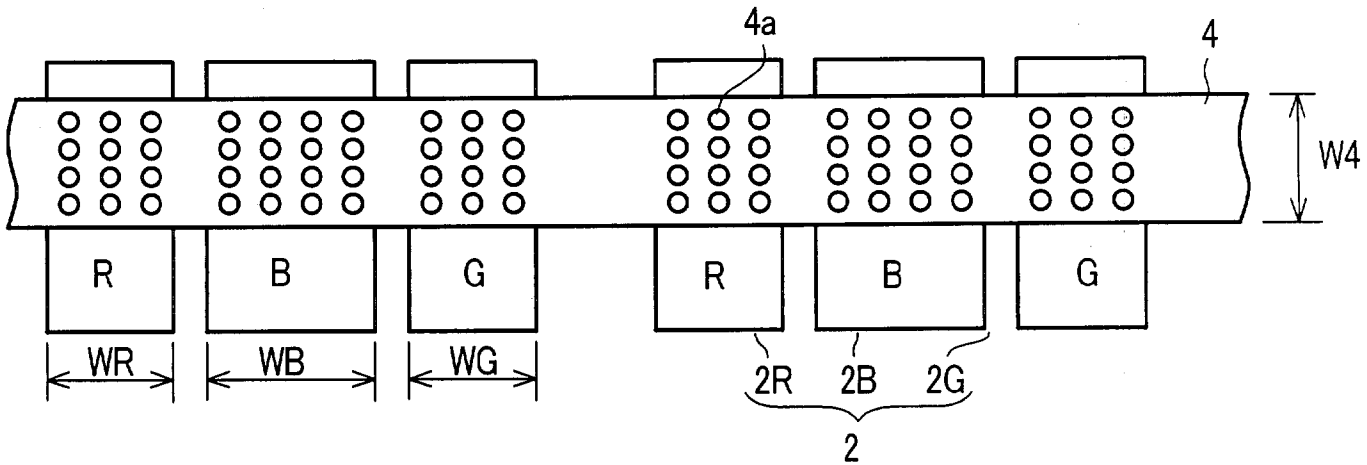

FIG. 9A to FIG. 9B are plan views showing an essential part as viewed from a front panel side in the back panel direction for explaining the eighth embodiment of the display device according to the present invention. Here, the widths of the cathode lines which constitute one color pixel are made different from each other. In the drawing, reference symbol WR indicates a width of the cathode line 2R corresponding to red, reference symbol WG indicates a width of the cathode line 2G corresponding to green, and reference symbol WB indicates a width of the cathode line 2B corresponding to blue. In FIG. 9A, the relationship among these widths is set to WB>WR, WG. That is, the width of the blue cathode line 2B whose contribution to chromaticity of color display is larger than the widths of the cathode lines of other colors. Assuming the width of the plate-like control electrode as W4, an area W4×WB corresponding to blue which is formed at a cross section of the blue cathode line 2B and the plate-like control electrode 4 is set larger than areas W4×WR, W4×WG corresponding to other colors.

Due to such a constitution, it is possible to easily set the number of electron passing holes corresponding to the blue portion of the plate-like control electrodes 4 which crosses the cathode line 2B larger than the number of electron passing holes 4*a* corresponding to portions of the plate-like control electrodes 4 which cross other cathode lines 2R, 2G. Accordingly, the number of electrons which are directed to the blue phosphor is increased compared to the number of electrons which are directed to the phosphors of other colors. In FIG. 9B, the blue cathode line 2B which makes a large contribution to chromaticity of color display is positioned between the red cathode line 2R and the green cathode line 2G. Also with respect to the red cathode line 2R and the green cathode line 2G, their widths may be made different and changed in conformity with the visibility curves. This embodiment is similar to other embodiments with respect to other constitutions. By adopting the above-mentioned constitution, this embodiment can provide the display device which exhibits a favorable color reproducibility.

Figure 10:
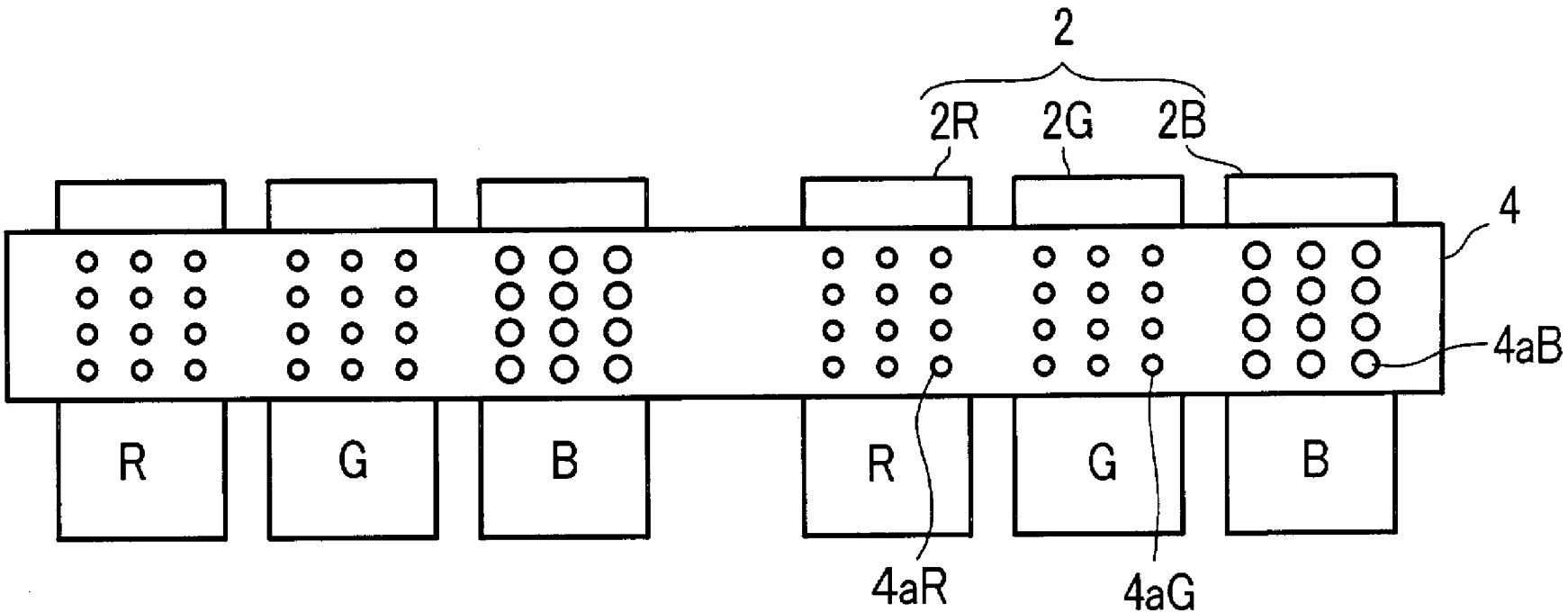
FIG. 10 is a plan view of an essential part as viewed in the back panel direction from a front panel side for explaining the ninth embodiment of the display device according to the present invention.

FIG. 10 is a plan view showing an essential part as viewed from a front panel side in the back panel direction for explaining the ninth embodiment of the display device according to the present invention. In this embodiment, the widths of cathode lines 2 of respective colors which belong to a group are set equal, while a size of electron passing holes 4*a*B formed in a portion of the plate-like control electrode 4 which crosses the blue cathode line 2 which makes a large contribution to the chromaticity of color display is set larger than sizes of the electron passing holes 4*a*R, 4*a*G formed in portions of the plate-like control electrode 4 which cross the cathode line 2 of other colors. Also with the provision of this constitution, it is possible to increase a quantity of electrons directed from the blue cathode line 2B which makes the large contribution to the chromaticity of color display toward the phosphor compared to a quantity of electrons directed from the cathode lines of other colors toward the phosphor. The blue cathode line may be positioned as shown in FIG. 9B. This embodiment is similar to other embodiments with respect to other constitutions. By adopting the above-mentioned constitution, this embodiment can provide the display device which exhibits a favorable color reproducibility. Further, in this embodiment, the widths of the phosphors may be changed.

As has been described above, by changing at least one of the width of the cathode lines 2, the size of the electron passing holes 4*a*, the number of electron passing holes 4*a* and the width of the phosphors in conformity with color, it is possible to enhance the color reproducibility.

Further, in the above-mentioned embodiment, although the example in which the blue cathode line 2B is arranged at the center of the group by focusing on the chromaticity at the time of performing grouping has been explained, it is preferable to arrange the green cathode line 2G at the center of the group by focusing on the luminance since green is most sensitive to human eyes.

Figure 11A:
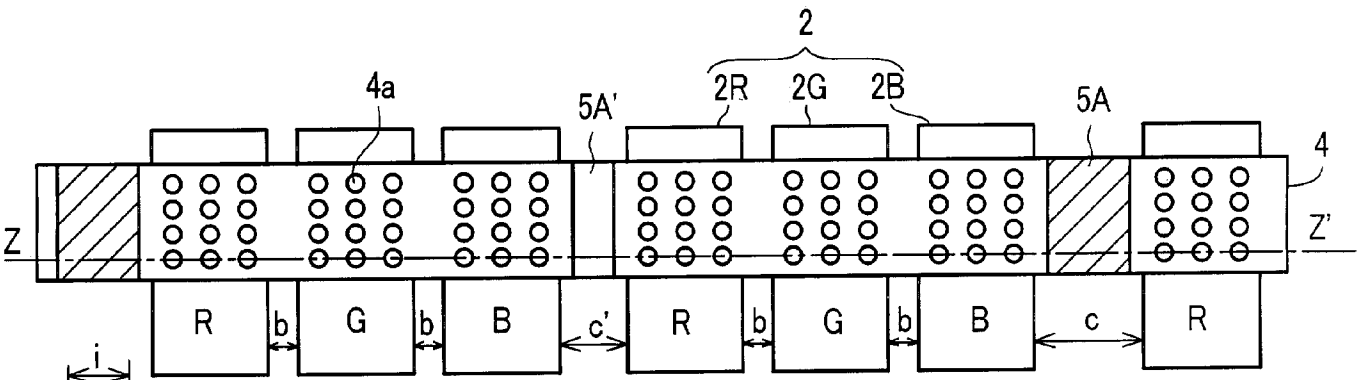
FIG. 11A and FIG. 11B are schematic views of the constitution of the back panel side for explaining the tenth embodiment of the display device according to the present invention.
Figure 11B:
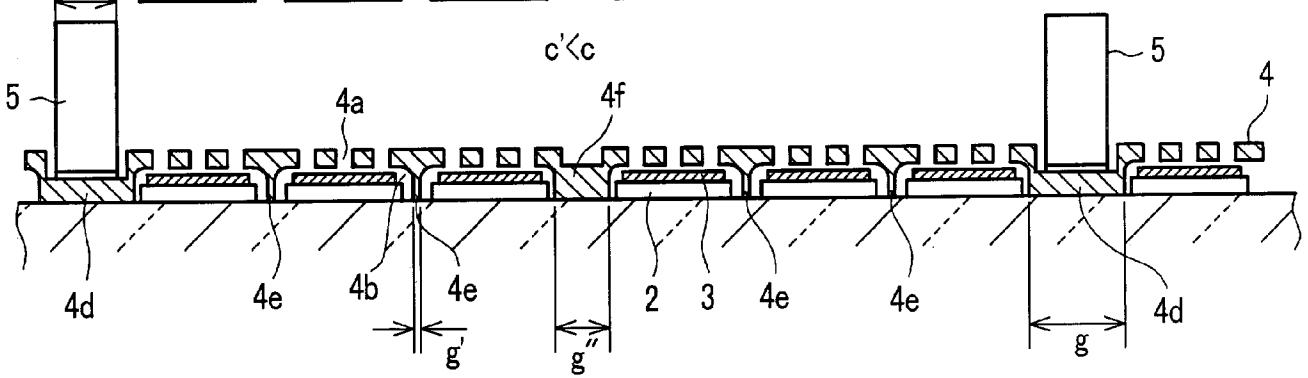

FIG. 11A and FIG. 11B are schematic views showing the constitution of a back panel side for explaining the tenth embodiment of the display device according to the present invention, wherein FIG. 11A is a plan view of an essential part as viewed in the back panel direction from a front panel side and FIG. 11B is a cross-sectional view taken along a line Z–Z' in FIG. 11A. This embodiment corresponds to a modification of the embodiment shown in FIG. 8A and FIG. 8B and is characterized in that a plate-like control electrode 4 is further provided with third protrusions 4*f* each of which is arranged between neighboring groups each forming one color pixel. In the same manner as the second protrusions 4*e* shown in FIG. 8B, the distance holding members 5 are not provided to the third protrusions 4*f* as well as the second protrusions 4*e* at a front panel side of the plate-like control electrode 4.

Although the distance holding members 5 are mounted on the front panel side of the first protrusion 4*d*, the distance holding members 5 are mounted neither on the second protrusion 4*f* nor on the third protrusions 4*f*. Accordingly, the third protrusions 4*f* shown in FIG. 11B may be referred to as a modification of the second protrusions 4*e* and these protrusions may be collectively expressed also as the second protrusions.

In this embodiment, two types of gaps c, c' are provided as the gap between the groups at the time of performing the grouping, wherein the relationship between these gaps is set as c'<c. Accordingly, three types of gaps b, c, c' are provided as the gap between the cathode lines 2 and the relationship among these gaps is set as b<c'<c. The third protrusion 4*f* is provided to the portion of the plate-like control electrode 4 at the gap c'. Here, a length g" of the third protrusion 4*f* as measured in the extending direction of the plate-like control electrode 4 is set smaller than a length g of the first protrusion 4*d* as measured in the extending direction of the plate-like control electrode 4. Further, the length g" is set larger than a length g' of the second protrusion 4*e* as measured in the extending direction of the plate-like control electrode 4.

In this embodiment, it is possible to obtain advantageous effects that, when the distance holding members 5 are mounted every two or more groups, between the neighboring color pixels, the numerical aperture can be enhanced while preventing electrons of one group from reaching the phosphor of the neighboring group. This is because that the gap c' can be narrowed. Further, it is also possible to suppress the deformation of the plate-like control electrode 4. Still further, it is needless to say that the above-mentioned constitutions of respective embodiments can be combined with each other.

Figure 12:
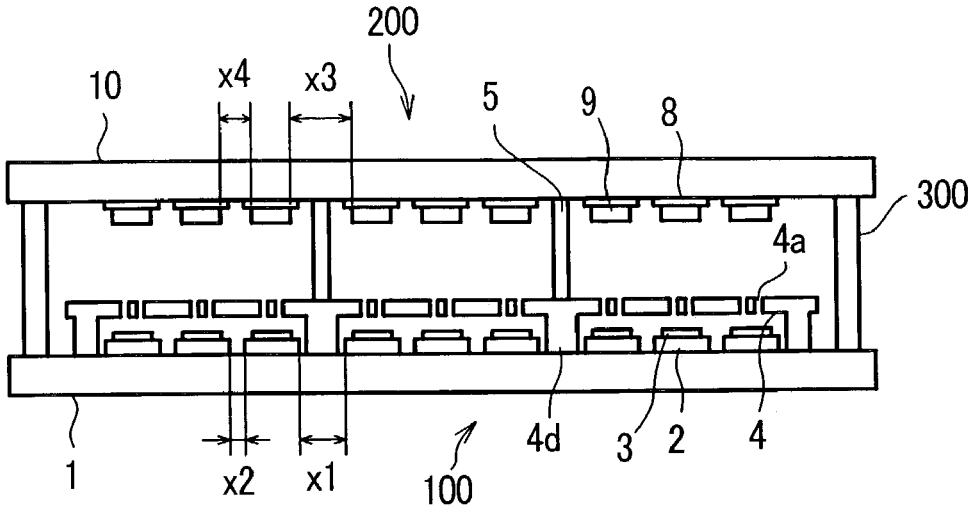
FIG. 12 is a schematic cross-sectional view for explaining an overall constitution of the display device of the present invention.

FIG. 12 is a schematic cross-sectional view for explaining the overall constitution of the display device according to the present invention. In the drawing, numeral 100 indicates aback panel, numeral 200 indicates a front panel and numeral 300 indicates a sealing frame. The back panel 100 includes a large number of cathode lines 2 which extend in one direction and are arranged in parallel in another direction which is perpendicular to one direction on an inner surface of the back substrate 1. The electron sources 3 such as carbon nanotubes or the like are mounted on the cathode lines 2. Further, the anodes 8 and the phosphors 9 are formed on an inner surface of the front substrate 10. The back panel 100 and the front panel 200 are arranged to define a given distance therebetween by means of the distance holding members 5. The sealing frame 300 is interposed between respective inner peripheries of both of the back panel 100 and the front panel 200 so as to laminate these panels 100, 200 to each other. The inside of the laminated structure is evacuated.

In this embodiment, the cathode lines 2 are grouped such that the gap defined between the cathode lines 2 is comprised of two types of gaps x1 and x2 which have the relationship of x1>x2. Although the phosphors 9 may be arranged equidistantly in the same manner as the conventional phosphors, in this embodiment, the phosphors 9 are also grouped in accordance with the gap between the cathode lines 2 such that the relationship between two or more types of gaps x3, x4 is set to x3>x4. Due to such a constitution, it is possible to reduce a quantity of electrons which impinge on the phosphors 9 of the neighboring group. Further, the anodes 8 may be also grouped.

Figure 13:
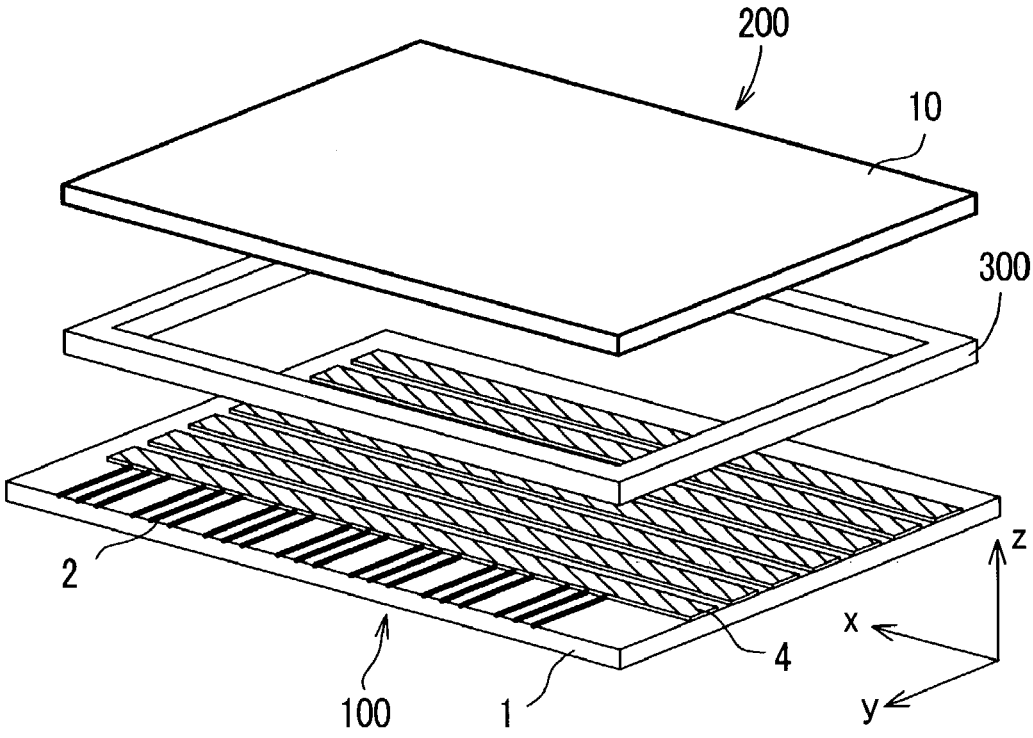
FIG. 13 is a developed perspective view for schematically explaining the overall constitution of the display device of the present invention shown in FIG. 12.

Further, FIG. 13 is a developed perspective view for schematically explaining the overall constitution of the display device according to the present invention shown in FIG. 12. As explained in FIG. 12, a large number of cathode lines 2 extend in one direction (y direction) on the inner surface of the back substrate 1 which constitutes the back panel 100 and a large number of control electrodes 4 which extend in another direction (x direction) which crosses one direction are formed over the cathode lines 2. The above-mentioned anodes 8 and phosphors 9 are formed on the inner surface of the front panel 200. The front panel 200 is laminated to the back panel 100 in the z direction by way of the sealing frame 300.

Figure 14:
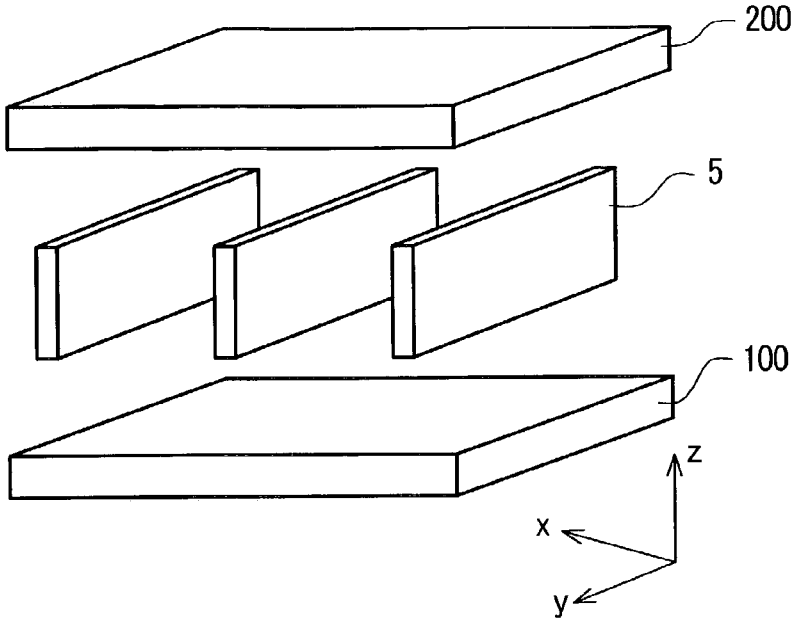
FIG. 14 is a developed perspective view for schematically explaining one example of a mounting state of distance holding members of the display device according to the present invention shown in FIG. 12.

FIG. 14 is a developed perspective view for schematically explaining one example of amounting state of the distance holding members 5 in the display device according to the present invention shown in FIG. 12. Here, the distance holding members 5 extend in the y direction, that is, in the extending direction of the cathode lines 2 and are arranged in parallel in the x direction.

The distance holding members 5 maybe, as shown in FIG. 12, arranged between respective cathode lines 2. However, as explained in the previous embodiments, it is preferable to mount the distance holding member 5 every one group of one color pixel or every plurality of groups in view of ensuring spaces for mounting the distance holding members 5 and for facilitating the assembling.

Figure 15:
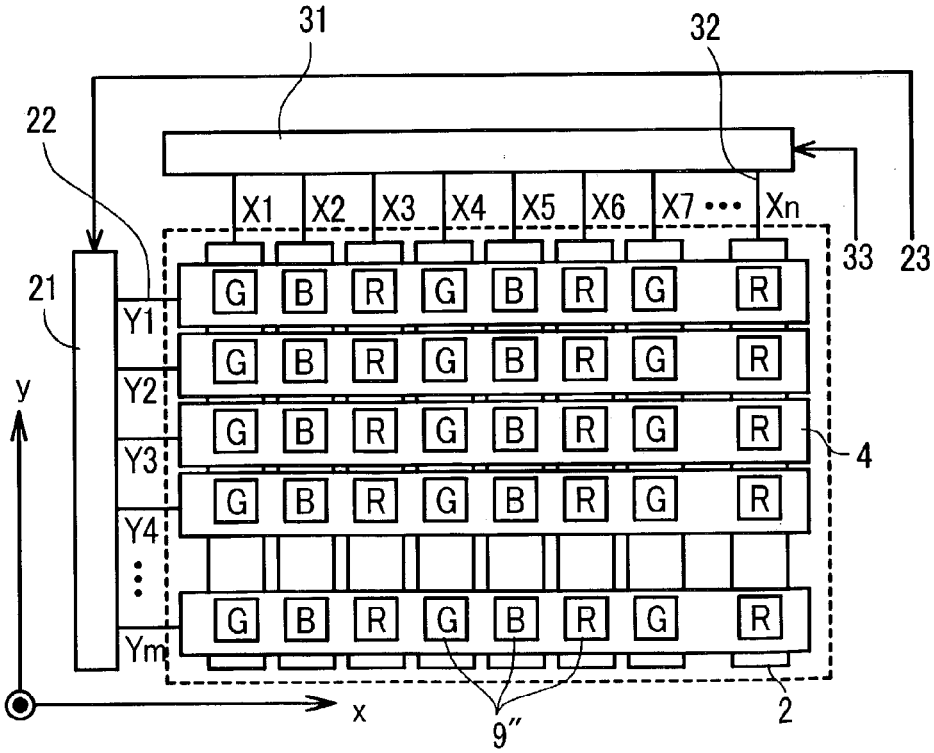
FIG. 15 is an explanatory view showing an example of an equivalent circuit of a display device of the present invention.

FIG. 15 is an explanatory view of an example of an equivalent circuit of the display device of the present invention. A region indicated by a broken line in the drawing is a display region and the cathode lines 2 and the control electrodes 4 are arranged such that they cross each other thus forming a matrix array of n×m in the display region. Each crossing portion of the matrix constitutes a unit pixel and one color pixel is constituted of a group consisting of "R", "G", "B" indicated by 9' in the drawing. The cathode lines 2 are connected to a video driving circuit 31 through cathode line lead lines 32 (X1, X2, . . . Xn), while the control electrodes 4 are connected to a control driving circuit 21 through the control electrode lead lines 22 (Y1, Y2, . . . Ym).

Video signals 33 are inputted to the video driving circuit 31 from an external signal source, while control signals (synchronous signals) 23 are inputted to the control driving circuit 21 in the same manner. In a monochroic display device, each crossing portion of the matrix constitutes one pixel.

Due to such a constitution, given pixels which are sequentially selected by the control electrodes 4 and the cathode lines 2 emit light with given colored lights thus displaying a two-dimensional image. With the provision of the display device having this constitutional example, it is possible to realize a flat panel type display device of high efficiency using a relatively low voltage.

Although the present invention has been explained in conjunction with various embodiments heretofore, the constitutional elements which are not inevitable in view of the objects and the advantageous effects of the present invention can be suitably omitted or changed. For example, in the display device in which the structure of the control electrode (also referred to as a pull-out electrode since electrons are pulled out from the electron source) is not limited to the plate member which is produced as a separate member, a thin film may be formed in place of using the plate member which constitutes the separate member. Further, the control electrode may adopt an under-gate structure which arranges the control electrode below the cathode line 2. Further, it may be possible to adopt the diode constitution by eliminating the control electrodes. Alternatively, it is possible to adopt the quadrode constitution by adding focus electrodes.

Further, the present invention is applicable not only to the single matrix type display device but also to an active matrix type display device which uses active elements. With respect to the constitution of the anodes 8 and the order of lamination of the anodes 8 and the phosphors 9, it is possible to adopt a so-called metal back structure in which the anodes 8 are made of metal and the phosphors 9 are arranged between the front substrate 10 and the anodes 8. Still further, it is needless to say that various modifications are conceivable besides the above-mentioned constitutions.

As has been described heretofore, according to the present invention, in adopting the constitution of the present invention, by mounting the distance holding members 5 at portions of the plate-like control electrode 4 corresponding to the larger gaps out of two or more types of gaps formed between the cathode lines 2, it is possible to sufficiently ensure the spaces for mounting the gap holding members 5. Further, the possibility that the protrusions formed on the back substrate 1 side of the plate-like control electrodes 4 are brought into contact with the cathode lines 2 can be reduced so that the numerical aperture can be enhanced. Further, the gap between the cathode lines 2 can be narrowed so that the definition of display images can be enhanced.

In this manner, according to the present invention, it is possible to provide the display device having the favorable display quality which can realize the electron emitting characteristics of high performance, wherein the display device can sufficiently ensure spaces for mounting distance holding members 5 when the distance holding members 5 are mounted in the gaps between the cathode lines 2 (electron sources) formed on the back substrate and can facilitate the assembling thereof.

What is claimed is:

1. A display device in which a back substrate having a large number of cathode lines which extend in one direction and are arranged in parallel in another direction which crosses one direction formed on an inner surface thereof and a front substrate having anodes and phosphors formed on an inner surface thereof are arranged to face each other in an opposed manner with a given distance therebetween, wherein the large number of cathode lines define at least two different types of gaps x1, x2 (gap x1>gap x2) between the large number of cathode lines formed on the inner surface of the back substrate, distance holding members which define the distance between the back substrate and the front substrate are provided in at least some of the gaps x1, a plurality of cathode lines are formed into groups and the gap between the groups which are arranged close to each other is set larger than the gap between the cathode lines belonging to the same group, and the cathode lines are extended in one direction in a zigzag pattern and the gap between the neighboring groups is displaced in the direction which crosses the extending direction of the cathode lines corresponding to the zigzag pattern of the cathode lines.

2. A display device according to claims 1, wherein 3N (N being a natural number) pieces of cathode lines are formed into one group.

3. A display device according to claims 1, wherein the gap between the cathode lines belonging to the same group is a gap x2 and the gap between the cathode lines belonging to the groups which are arranged close to each other is a gap x1.

4. A display device in which a back substrate having a large number of cathode lines which extend in one direction and are arranged in parallel in another direction which crosses one direction formed on an inner surface thereof and a front substrate having anodes and phosphors formed on an inner surface thereof are arranged to face each other in an opposed manner with a given distance therebetween, wherein a large number of plate-like control electrodes are formed such that the plate-like control electrodes are arranged close to the cathode lines, extend in another direction, are arranged in parallel in one direction, and have electron passing holes formed therein, the large number of cathode lines define at least two different types of gaps x1, x2 (gap x1>gap x2) between the large number of cathode lines formed on the inner surface of the back substrate, a plurality of cathode lines are formed into each one group and the gap between the cathode lines belonging to the groups which are arranged close to each other is the gap x1, and the plate-like control electrodes include first protrusions in at least some of the gaps x1, wherein the first protrusions approach closer to the back substrate than regions of the plate-like control electrodes where the electron passing holes are formed.

5. A display device according to claim 4, wherein the first protrusions are brought into contact with the back substrate.

6. A display device according to claim 4, wherein distance holding members which hold a distance between the back substrate and the front substrate to a given value are provided to front substrate sides of the first protrusions.

7. A display device according to claim 4, wherein the plate-like control electrodes includes second protrusions in at least some of the gaps x2, wherein the second protrusions approach closer to the back substrate than regions of the plate-like control electrodes where the electron passing holes are formed.

8. A display device according to claim 7, wherein the second protrusions have a length shorter than a length of the first protrusions as measured in an extending direction of the plate-like control electrode.

9. A display device according to claim 4, wherein 3N (N being a natural number) pieces of cathode lines are formed into one group.

10. A display device according to claim 4, wherein the cathode lines are extended in one direction in a zigzag pattern and the gap between the neighboring groups is displaced in the direction which crosses the extending direction of the cathode lines corresponding to the zigzag pattern of the cathode lines.

11. A display device according to claim 4, wherein the plate-like control electrodes are metal plates.

12. A display device according to claim 4, wherein two or more cathode lines are arranged between at least some neighboring first protrusions.

* * * * *